US006266587B1

(12) United States Patent
Guertler et al.

(10) Patent No.: US 6,266,587 B1
(45) Date of Patent: Jul. 24, 2001

(54) METHOD FOR DETERMINING THE TIMES WHEN IT WILL BE NECESSARY TO CHANGE, OR ADD TO, THE ENGINE OIL IN A MOTOR VEHICLE ENGINE

(75) Inventors: Thomas Guertler, Stuttgart; Markus Harfmann, Tuttlingen; Klaus Land, Denkendorf; Rudolf Thom, Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/319,538

(22) PCT Filed: Dec. 15, 1997

(86) PCT No.: PCT/EP97/07040

§ 371 Date: Jun. 8, 1999

§ 102(e) Date: Jun. 8, 1999

(87) PCT Pub. No.: WO98/29642

PCT Pub. Date: Jul. 9, 1998

(30) Foreign Application Priority Data

Dec. 27, 1996 (DE) ..... 196 54 450

(51) Int. Cl.[7] ..... G06F 19/00; G06F 7/00

(52) U.S. Cl. ..... 701/30; 73/117.3; 73/116; 340/457.4; 340/438

(58) Field of Search ..... 701/30; 73/117.3, 73/116; 340/457.4, 438

(56) References Cited

U.S. PATENT DOCUMENTS 4,706,193 * 11/1987 Imajo et al. ..... 701/30
4,862,393 8/1989 Reid et al. .
6,009,361 * 12/1999 Huber et al. ..... 701/29

FOREIGN PATENT DOCUMENTS 40 38 972 C1 11/1991 (DE) .
44 29 234 A1 8/1995 (DE) .
0 191 458 A1 8/1986 (EP) .
0 231 055 A2 8/1987 (EP) .

* cited by examiner

*Primary Examiner*—William A. Cuchlinski, Jr.
*Assistant Examiner*—Olga Hernandez
(74) *Attorney, Agent, or Firm*—Evenson, McKeown, Edwards & Lenahan, P.L.L.C.

(57) ABSTRACT

The invention relates to a method for determining engine oil servicing dates for a motor vehicle engine as a function of recorded engine operating parameters. According to the invention, the number of engine revolutions and at least one engine other operating parameter relevant to engine oil ageing are continuously recorded and, on the basis of this, a fictitious distance is determined by associating the recorded engine revolutions with the evaluation factors dependent on recorded engine operating parameter(s) relevant to engine oil ageing in accordance with a predeterminable association relationship. From this, a remaining operating distance until the next engine oil servicing date is then calculated by subtracting the determined fictitious distance from a specified total distance potential.

4 Claims, 2 Drawing Sheets

METHOD FOR DETERMINING THE TIMES WHEN IT WILL BE NECESSARY TO CHANGE, OR ADD TO, THE ENGINE OIL IN A MOTOR VEHICLE ENGINE

BACKGROUND AND SUMMARY OF THE INVENTION

The invention relates to a method for determining engine oil servicing dates for a motor vehicle engine as a function of recorded engine operating parameters.

A method is described in the Patent Specification DE 40 38 972 C1 for determining engine oil servicing dates for a motor vehicle engine as a function of recorded engine operating parameters, such as number of starts, crankshaft revolutions, driving and stationary periods, engine temperature, engine oil pressure, boost air pressure, oil consumption and fuel consumption, using an algorithm, which is not described in any more detail in the publication. The date is displayed by means, for example, of a series of light-emitting diodes or a digital display. In the method described in that publication, engine oil top-up processes are taken into account in the calculation of the servicing date by allowing the date to be delayed once by a defined period or a defined number of kilometers; it being possible to record the oil top-up amount quantitatively.

Methods for the automatic determination of engine oil quantity, such as are published in Offenlegungsschrift DE 44 29 234 A1 and German Patent Application No. 196 02 599.0, permit very reliable determination of the instantaneous engine oil quantity present even while the vehicle is in operation. By means, the oil consumption and the oil quantities added during oil changes or top-up procedures can be reliably recorded.

A method of the type mentioned at the beginning is described in Offenlegungsschrift EP 0 231 055 A2, in which the engine oil temperature is continuously recorded as the only operating parameter relevant to engine oil ageing and is used for evaluating the recorded engine revolutions, which procedure is carried out in this publication by means of a "penalty factor". Within a favourable engine oil temperature range, this penalty factor has the value of unity and, from there, it increases to larger values for both lower and higher engine oil temperatures. The result is that the actual total distance potential to the next recommended oil change is, at most, equally large and, generally speaking, is markedly less than the respective initially predetermined total distance potential.

The present invention is based, on the technical problem, of providing a method of the type mentioned at the beginning by means of which it is possible to determine, comparatively reliably, the date at which an engine oil servicing and therefore an engine oil change is desirable for a motor vehicle engine.

The present invention achieves this object by the provision of a method wherein one or more engine operating parameters relevant to engine oil ageing are continuously recorded by sensor means and associated evaluation factors are formed from them. The engine revolutions which have taken place are also recorded. In general, the concept of engine revolutions should be understood here to mean the revolutions of a crankshaft of the engine, which can for example be determined from the measured engine speed. The engine revolutions recorded are converted into a fictitious distance by evaluational association with the evaluation factors in accordance with a predeterminable association relationship. The remaining operating distance until a next engine oil servicing date is then calculated by subtracting this fictitious distance from a predeterminable total distance potential. It is found that this way of determining the engine oil servicing date by evaluating the revolutions of the motor vehicle engine as a function of the respective engine operating conditions presents a very reliable prediction of the appropriate engine oil usage time.

In the method according to the present invention special provision is made for the engine speed or the engine load to form a respective engine operating parameter relevant to engine oil ageing. It is found that a comparatively reliable estimate of the date for engine oil servicing or an engine oil change can be achieved by this means.

In another aspect of the inventive method, evaluation factors with respect to the engine oil temperature, the engine speed and the engine load and, as an option, the fuel consumption are determined on the basis of stored characteristic curves with which the engine revolutions are multiplied in order to obtain the fictitious distance. The evaluation factor characteristic curves can, for example, be determined on the basis of empirical values and/or the fundamental considerations familiar to the person skilled in the art with respect to the influences of the various engine operating parameters on the ageing of the engine oil.

According to another aspect of the invention, special provision is made for the total distance potential to be predetermined variably as a function of the oil quantity present directly after a previous oil change and/or of oil quantities added during oil top-up procedures. This makes it possible to take account of the fact that the total distance potential is, on the one hand, less for a smaller oil change quantity and, on the other hand, can be increased in the case of oil top-up processes as a function of their dates and the respective proportion of the freshly added oil quantity.

According to another aspect of the present invention, a calculation of a remaining operating period until a next engine oil servicing date takes place in addition to the remaining operating distance calculation, and independently of it, by subtraction of a determined fictitious oil use time from a specified initial operating period. The fictitious oil use time is then determined by associating the actual usage time since a previous oil change with a period evaluation factor which depends on the ratio of the fictitious distance determined to the distance actually travelled. By this means, flexible periodic servicing with respect to engine oil changes can be achieved depending on the driving style. This procedure also takes account of the fact that the engine oil ages to a certain extent when driving short distances, which makes engine oil changing desirable after a certain maximum use time at the latest, irrespective of the distance driven.

BRIEF DESCRIPTION OF THE DRAWINGS

An advantageous embodiment of the invention is described below and is shown in the drawings, in which.

DETAILED DESCRIPTION OF THE DRAWINGS

Figure 1:
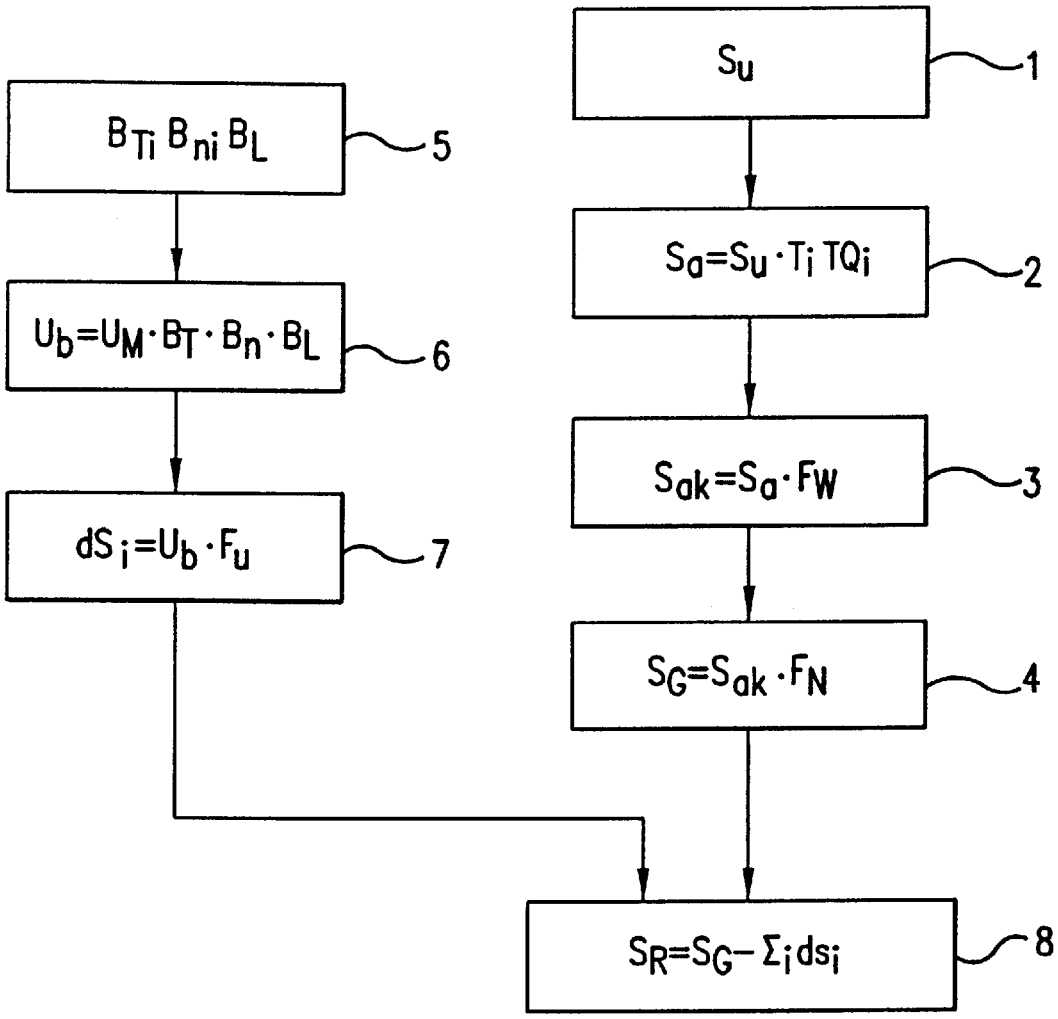
FIG. 1 shows a diagrammatic flowchart of a method for determining engine oil servicing dates for a motor vehicle engine, with remaining operating distance calculation

The sequence shown schematically in the two figures permits comparatively reliable prediction of a next respective favourable engine oil change date for a motor vehicle engine. In a first step 1, an original distance potential $S_U$ is first predetermined, for example in the form of a driving distance of 15,000 km. In a next step 2, an initial distance potential $S_a$ is determined by multiplying the original distance potential $S_U$ by one or preferably a plurality of quality factors $Q_i$. Such quality factors $Q_i$ can, for example, refer to the quality of the engine oil used, to the type of engine used, to the fuel used, to the country where the vehicle is used, to existing official regulations and to a reserve factor. From this initial distance potential $S_a$, a corrected initial distance potential $S_{ak}$ is then determined by multiplying the former by an oil change factor $F_w$ which indicates the oil quantity which was actually added during a preceding oil change (step 3). The oil change quantity in question can be very reliably determined in a known manner by, for example, an oil changing process using the method described in the German Patent Application No. 196 02 599.0 , cited above. The oil change factor $F_w$ can be formed for example by the ratio of the added oil change quantity to a standardized normal filling quantity.

In a next step 4, the determination of a total distance potential $S_G$ takes place from the corrected initial distance potential $S_{ak}$ by taking account of possible intervening oil top-up processes, in which used oil is partially or completely replaced by fresh engine oil. For this purpose, the corrected initial distance potential $S_{ak}$ is multiplied by an oil top-up factor $F_N$, which takes the value of 1 provided no oil top-up has taken place and which is increased in a predeterminable manner with each top-up process. The increments increasing this factor $F_N$ are selected in such a way that they increase with increasing oil top-up quantity and decrease with increasing time or distance travelled since the last oil change with the same top-up quantity. This takes account of the fact that an increasing quantity of fresh top-up oil increasingly reduces the age of the oil present in total, and that a respective oil top-up quantity which is added to an already more greatly aged remaining oil quantity causes less oil refreshing effect than the addition to a remaining oil quantity which has not been aged so greatly. These oil top-up quantities can also be very reliably determined, for example, by the method described in the German Patent Application mentioned above and, in fact, can also be determined while the vehicle is being driven.

Fictitious distances travelled $dS_i$, which are determined as follows, are continuously subtracted from the total distance potential $S_G$ determined in this way. In a step 5, three evaluation factors are obtained: an oil temperature evaluation factor $B_T$, an engine speed evaluation factor $B_n$ and an engine load evaluation factor $B_L$. For this purpose, the appropriate engine operating parameters are continuously recorded directly or indirectly by sensor means and from these, the three evaluation factors $B_T$, $B_n$ n and $B_L$ are obtained by means of appropriate characteristic curves. If required, the fuel consumption can be taken into account as a further engine operating parameter relevant to engine oil ageing, this information usually being available in any case in modern engine electronic systems. An additional fuel-consumption evaluation factor is then determined by means of a corresponding characteristic curve. In addition, the number of engine revolutions $U_M$, i.e. crankshaft revolutions, is also continuously recorded. In a next step 6, the engine revolutions $U_m$ are then evaluated by the engine revolutions recorded within a predetermined, actually travelled distance of, for example, one kilometer in each case, being added up and multiplied by the current values of the evaluation factors. The evaluated number of engine revolutions $U_b$ per distance travelled obtained in this way is then converted, in a subsequent step 7, into a fictitious distance $dS_i$ by means of a suitable conversion factor $F_u$. This fictitious distance $dS_i$ . is a measure of the loading of the engine oil during the respectively associated, actually driven distance.

Depending on the driving situation, the fictitious distance is approximately, for example, between 0.5 times and three times the predetermined, actually driven distance. If required, this fictitious distance interval $dS_i$ can also be limited to such a predetermined value range. In addition, the fictitious distance increments $dS_i$ can be determined separately for vehicle speeds below a predetermined, low speed threshold in order to take account of idling conditions in which, for example, the respective fictitious distance increment is limited to the length of the predetermined, actually driven distance where the other type of determination method would lead to a higher value.

Whenever the vehicle has travelled a predetermined distance of 1 km, for example, which is recorded by an appropriate distance measuring device which is present in any case in the vehicle, the associated fictitious distance increment $dS_i$ is subtracted from the total distance potential $S_G$ in order to determine the respective operating distance $S_R$ (step 8) still remaining. The remaining operating distance $S_R$ then gives the distance which can still be travelled by the vehicle before the next engine oil change should take place.

The vehicle driver can be informed of the current value of the remaining operating distance $S_R$ by means of a suitable display in any desired manner. As an example, an automatic visual display of the remaining operating distance can be provided when this distance falls below a warning threshold, which depends on the average daily distance travelled by the vehicle. In addition, it is possible to provide for no evaluation of the engine revolutions, and therefore no determination of fictitious distance segments, to be undertaken when the remaining operating distance has fallen below a threshold value of for example 500 km, which can be predetermined for this purpose, but from this point onward, for the actually driven distance to be subtracted from the remaining operating distance. By this means, a calculable remaining operating distance without evaluation effects is indicated to the vehicle driver shortly before necessary oil changes.

If required, a permissible value range for the respectively remaining operating distance can be predetermined as a function of the actually driven distance, the respectively determined remaining operating distance being limited to that distance when a range limit is exceeded. As an example, a lower limit value for the range can be set as the difference between the initial distance potential and the actually driven distance since the last oil change, and an upper limiting value for the range can be set as the product of a predetermined minimum fictitious distance per actually driven distance, and the difference between double the initial distance potential and the actual distance driven since the last oil change.

Figure 2:
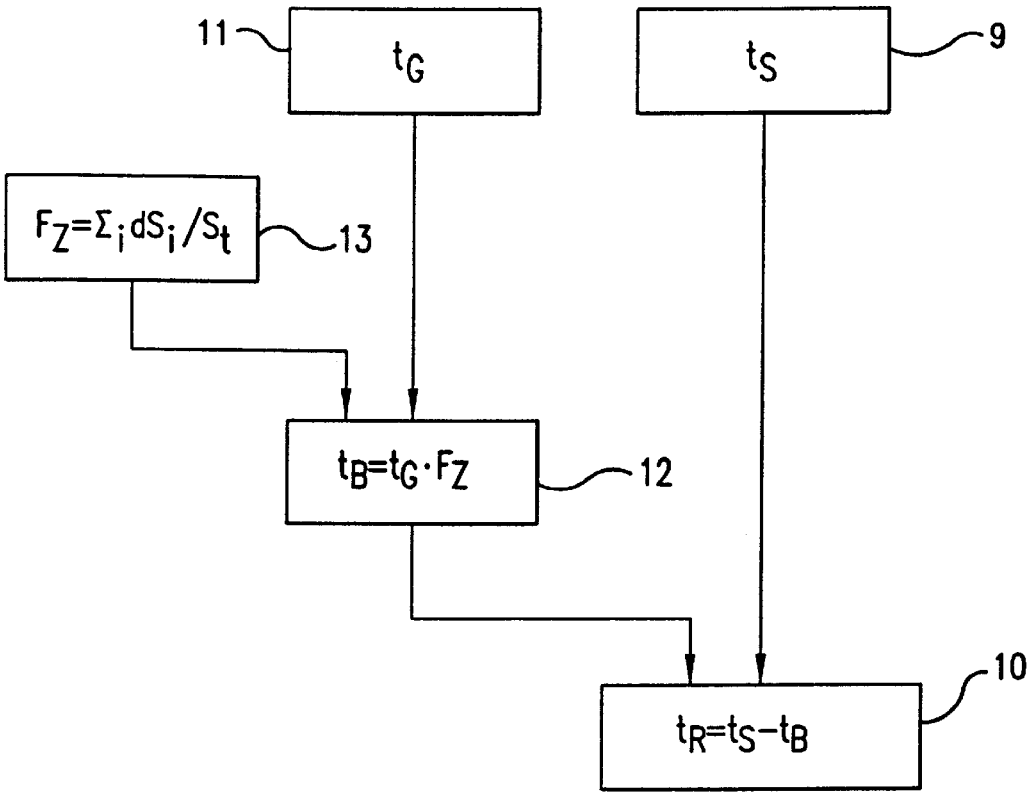
FIG. 2 shows a diagrammatic flowchart of part of a method calculating for a remaining operating period which part can be provided in addition to the method in accordance with FIG. 1.

In parallel with the remaining operating distance determination described above, the method shown as an example includes remaining operating period determination by means of which the remaining operating period until the next engine oil change date is determined independently of the remaining operating distance determination explained above. The associated part of the method is illustrated in FIG. 2.

An initial operating period $t_s$ is first determined in a step 9. This can take place depending on the driving style. In the case of a careful style of driving, for example, the initial operating period can be twice as long as that in the case of a driving style imposing severe loads. The maximum predetermined initial operating period can be limited as a function of official regulations, for example to two years in order to ensure engine oil changes at least within certain, specified intervals.

From the initial operating period $t_S$ established in this way, fictitious period increments $t_B$ are then continuously subtracted (step 10) in order to determine the remaining operating period $t_R$ still available. These fictitious period increments $t_B$ are determined as follows. The actual period $t_G$ since the last oil change is first recorded in a relevant method step 11 by, for example, by incrementing the day counter by the amount of one per day. In order to obtain the respective fictitious period increment $t_B$, this period $t_G$ since the last oil change procedure is then multiplied, in a subsequent step 12, by a period evaluation factor $F_z$. The period evaluation factor $F_Z$ is established, in an associated method step 13, as the ratio of the sum of the fictitious distance increments $dS_i$ calculated during the remaining operating distance determination to the actually travelled distance $S_t$, which corresponds to an average of the fictitious distance increments $dS_i$ determined per actually driven distance interval. It is then possible to limit the period evaluation factor $F_Z$ to a predetermined value range, for example to the interval between 1 and 2 in order to avoid inappropriately frequent oil changes, on the one hand, and to avoid excessively long oil change intervals, on the other. Within these possible established range limits, this part of the method achieves flexible periodic servicing with regard to engine oil changes, for example between one year and two years in each case, depending on the driving style.

The respectively determined remaining operating period $t_R$ can be displayed to the vehicle driver in any desired manner. The remaining operating period display can then be combined with the remaining operating distance display in such a way, for example, that a visual remaining operating distance display is produced primarily on reaching the relevant conditions mentioned above. When the remaining operating period $t_R$ has fallen below a predetermined warning threshold, an audible and/or visual servicing warning due is initiated. From this date, only the actual period—without evaluation—is subtracted from the remaining remaining operating period in order to provide the driver, in turn, with calculable information on the date when the next engine oil change should take place. If, in addition, the remaining operating period determined, multiplied by a predetermined conversion factor, is shorter than the remaining operating distance determined, it is desirable to change from the visual remaining operating distance, display to an visual remaining operating period display, because the remaining operating period display and not the remaining operating distance is then the determining parameter for the most favourable date for the next engine oil change. If the remaining operating period is measured in days and a remaining operating distance is measured in kilometers, the associated conversion factor can, for example, be of the order of magnitude of 40.

By means of combined determination of the remaining operating distance and the remaining operating period, the method described above makes comparatively reliable information available to the vehicle driver on the date at which the next engine oil change is desirable, taking account of the driving situation or the driving style since the last oil change. It is obvious that the various parameters, mentioned above, of the method according to the invention can be suitably defined by the person skilled in the art to suit the application without these being limited to the explicit values given as examples above. The engine operating parameters respectively relevant for determining the remaining operating distance or remaining operating period can be also correspondingly selected or established by the person skilled in the art. If required, the method according to the invention can also be implemented without remaining operating period determination, limited to the remaining operating distance determination.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A method for determining engine oil servicing dates for a motor vehicle engine as a function of recorded engine operating parameters, comprising:

continuously recording engine revolutions and at least one engine operating parameter relevant to engine oil ageing;

determining a fictitious distance ($dS_i$) by associating the recorded engine revolutions with evaluation factors ($B_T$, $B_n$, $B_L$) that are dependent on the at least one engine operating parameter relevant to engine oil ageing in accordance with a predeterminable association relationship;

calculating a remaining operating distance ($S_R$) until a next engine oil servicing date by subtracting the fictitious distance from a predetermined total distance potential ($S_G$); and determining a remaining operating period by;

determining a fictitious oil usage time ($t_B$) by an evaluational association of actual oil consumption duration ($t_G$) with a period evaluation factor ($F_Z$) which depends on the ratio of the determined fictitious distance ($dS_i$) to the actually travelled distance ($S_t$); and calculating a remaining operating period ($t_R$) until a next engine oil servicing date by subtracting the fictitious oil usage time ($t_B$) from a predetermined initial running period ($t_S$).

2. A method for determining engine oil servicing dates for a motor vehicle engine as a function of recorded engine operating parameters, comprising:

continuously recording engine revolutions and at least one engine operating parameter relevant to engine oil ageing;

determining a fictitious distance ($dS_i$) by associating the recorded engine revolutions with evaluation factors ($B_T$, $B_n$, $B_L$) dependent on the at least one engine operating parameter relevant to engine oil ageing in accordance with a predeterminable association relationship; and calculating a remaining operating distance ($S_R$) until a next engine oil servicing date by subtracting the determined fictitious distance from a predetermined total distance potential ($S_G$).

3. A method according to claim 2, wherein:

the at least one operating parameter relevant to engine oil ageing includes one or more of engine oil temperature, engine speed, engine load and fuel consumption, and wherein the associated evaluation factors ($B_T$, $B_n$, $B_L$) are determined by using stored characteristic curves and;

the determined associated evaluation factors ($B_T$, $B_n$, $B_L$) are multiplicatively associated with the recorded engine revolutions in order to determine the fictitious distance ($dS_i$).

4. A method for determining engine oil servicing dates for a motor vehicle engine as a function of recorded engine operating parameters comprising:

continuously recording engine revolutions and at least one engine operating parameter relevant to engine oil ageing;

determining a fictitious distance ($dS_i$) by associating the recorded engine revolutions with evaluation factors ($B_T$, $B_n$, $B_L$) that are dependent on the at least one engine operating parameter relevant to engine oil ageing in accordance with a predeterminable association relationship;

predetermining a total distance potential ($S_G$) as the product of a permanently predeterminable original distance potential ($S_u$) and one or more of: quality factors ($Q_i$), oil change or oil top-up factors ($F_W$, $F_N$), the oil change or oil top-up factors being determined as a function of respective oil change quantity or oil top-up quantity; and calculating a remaining operating distance ($S_R$) until a next engine oil servicing date by subtracting the determined fictitious distance from the predetermined total distance potential ($S_G$).

* * * * *